US009637688B2

(12) United States Patent
Fu et al.

(10) Patent No.: US 9,637,688 B2
(45) Date of Patent: May 2, 2017

(54) RARE EARTH-CONTAINING ATTRITION RESISTANT VANADIUM TRAP FOR CATALYTIC CRACKING CATALYST

(71) Applicant: BASF Corporation, Florham Park, NJ (US)

(72) Inventors: Qi Fu, Solon, OH (US); Walter Babbitt, Spring Lake Heights, NJ (US); Mark Schmalfeld, Fanwood, NJ (US); Chandrashekhar Pandurang Kelkar, Bridgewater, NJ (US)

(73) Assignee: BASF Corporation, Florham Park, NJ (US)

( * ) Notice: Subject to any disclaimer, the term of this patent is extended or adjusted under 35 U.S.C. 154(b) by 0 days.

(21) Appl. No.: 14/636,229

(22) Filed: Mar. 3, 2015

(65) Prior Publication Data

US 2015/0175901 A1 Jun. 25, 2015

Related U.S. Application Data

(62) Division of application No. 13/005,239, filed on Jan. 12, 2011.

(51) Int. Cl.

| | |
|---|---|
| ***B01J 20/08*** | (2006.01) |
| ***B01J 20/10*** | (2006.01) |
| ***B01J 20/12*** | (2006.01) |
| ***C10G 11/05*** | (2006.01) |
| ***C10G 11/18*** | (2006.01) |
| ***C10G 25/09*** | (2006.01) |

(52) U.S. Cl.

CPC ..... *C10G 11/05* (2013.01); *C10G 11/18* (2013.01); *C10G 25/09* (2013.01); *C10G 2300/205* (2013.01); *C10G 2300/705* (2013.01)

(58) Field of Classification Search

CPC ..... B01J 20/0207; B01J 20/08; B01J 20/10; B01J 20/12

See application file for complete search history.

(56) References Cited

U.S. PATENT DOCUMENTS

| | | | | |
|---|---|---|---|---|
| 3,537,816 | A | 11/1970 | Moscou | |
| 3,711,422 | A | 1/1973 | Johnson | |
| 4,025,458 | A | 5/1977 | McKay | |
| 4,031,002 | A | 6/1977 | McKay | |
| 4,111,845 | A | 9/1978 | McKay | |
| 4,148,714 | A | 4/1979 | Nielsen et al. | |
| 4,153,536 | A | 5/1979 | McKay | |
| 4,166,806 | A | 9/1979 | McKay et al. | |
| 4,190,552 | A | 2/1980 | Bertus et al. | |
| 4,198,317 | A | 4/1980 | Bertus et al. | |
| 4,238,362 | A | 12/1980 | Bertus et al. | |
| 4,255,287 | A | 3/1981 | Bertus et al. | |
| 4,432,890 | A | 2/1984 | Beck et al. | |
| 4,457,833 | A | 7/1984 | Zandona et al. | |
| 4,465,779 | A | 8/1984 | Occelli et al. | |
| 4,493,902 | A | 1/1985 | Brown et al. | |
| 4,513,093 | A | 4/1985 | Beck et al. | |
| 4,515,683 | A | 5/1985 | Beck et al. | |
| 4,515,903 | A | 5/1985 | Otterstedt et al. | |
| 4,549,958 | A | 10/1985 | Beck et al. | |
| 4,781,818 | A * | 11/1988 | Reagan | C10G 25/003 208/120.01 |
| 4,900,428 | A | 2/1990 | Mester | |
| 4,913,801 | A | 4/1990 | Forester | |
| 4,919,787 | A | 4/1990 | Chester et al. | |
| 4,921,824 | A * | 5/1990 | Chin | B01J 23/10 208/113 |
| 5,001,096 | A | 3/1991 | Chu et al. | |
| 5,082,814 | A | 1/1992 | Stockwell et al. | |
| 5,384,041 | A | 1/1995 | Deeba et al. | |
| 5,603,823 | A | 2/1997 | Kim | |
| 5,965,474 | A | 10/1999 | Balko et al. | |
| 6,159,887 | A | 12/2000 | Trujillo et al. | |
| 6,673,235 | B2 | 1/2004 | Harris et al. | |
| 6,716,338 | B2 | 4/2004 | Madon et al. | |
| 2003/0050181 | A1* | 3/2003 | Gibson | B01J 29/084 502/64 |
| 2008/0314798 | A1* | 12/2008 | Stockwell | B01J 29/084 208/118 |

FOREIGN PATENT DOCUMENTS

| | | |
|---|---|---|
| GB | 2140791 | 12/1984 |
| WO | WO2009089020 | 7/2009 |

* cited by examiner

*Primary Examiner* — Randy Boyer
(74) *Attorney, Agent, or Firm* — Lowenstein Sandler LLP

(57) ABSTRACT

The present invention provides a metal passivator/trap comprising a rare earth oxide dispersed on a matrix containing a calcined hydrous kaolin.

10 Claims, No Drawings

RARE EARTH-CONTAINING ATTRITION RESISTANT VANADIUM TRAP FOR CATALYTIC CRACKING CATALYST

FIELD OF THE INVENTION

The present invention provides a metal passivator/trap and methods to mitigate the deleterious effect of metals on catalytic cracking of hydrocarbon feedstocks.

BACKGROUND OF THE INVENTION

Catalytic cracking is a petroleum refining process that is applied commercially on a very large scale. About 50% of the refinery gasoline blending pool in the United States is produced by this process, with almost all being produced using the fluid catalytic cracking (FCC) process. In the FCC process, heavy hydrocarbon fractions are converted into lighter products by reactions taking place at high temperatures in the presence of a catalyst, with the majority of the conversion or cracking occurring in the gas phase. The FCC hydrocarbon feedstock (feedstock) is thereby converted into gasoline and other liquid cracking products as well as lighter gaseous cracking products of four or fewer carbon atoms per molecule. These products, liquid and gas, consist of saturated and unsaturated hydrocarbons.

In FCC processes, feedstock is injected into the riser section of a FCC reactor, where the feedstock is cracked into lighter, more valuable products upon contacting hot catalyst circulated to the riser-reactor from a catalyst regenerator. As the endothermic cracking reactions take place, carbon is deposited onto the catalyst. This carbon, known as coke, reduces the activity of the catalyst and the catalyst must be regenerated to revive its activity. The catalyst and hydrocarbon vapors are carried up the riser to the disengagement section of the FCC reactor, where they are separated. Subsequently, the catalyst flows into a stripping section, where the hydrocarbon vapors entrained with the catalyst are stripped by steam injection. Following removal of occluded hydrocarbons from the spent cracking catalyst, the stripped catalyst flows through a spent catalyst standpipe and into a catalyst regenerator.

Typically, catalyst is regenerated by introducing air into the regenerator and burning off the coke to restore catalyst activity. These coke combustion reactions are highly exothermic and as a result, heat the catalyst. The hot, reactivated catalyst flows through the regenerated catalyst standpipe back to the riser to complete the catalyst cycle. The coke combustion exhaust gas stream rises to the top of the regenerator and leaves the regenerator through the regenerator flue. The exhaust gas generally contains nitrogen oxides (NOx), sulfur oxides (SOx), carbon monoxide (CO), oxygen ($O_2$), HCN or ammonia, nitrogen and carbon dioxide ($CO_2$).

The three characteristic steps of the FCC process that the cracking catalyst undergoes can therefore be distinguished: 1) a cracking step in which feedstock is converted into lighter products, 2) a stripping step to remove hydrocarbons adsorbed on the catalyst, and 3) a regeneration step to burn off coke deposited on the catalyst. The regenerated catalyst is then reused in the cracking step.

A major breakthrough in FCC catalysts came in the early 1960's, with the introduction of molecular sieves or zeolites. These materials were incorporated into the matrix of amorphous and/or amorphous/kaolin materials constituting the FCC catalysts of that time. These new zeolitic catalysts, containing a crystalline aluminosilicate zeolite in an amorphous or amorphous/kaolin matrix of silica, alumina, silica-alumina, kaolin, clay or the like were at least 1,000-10,000 times more active for cracking hydrocarbons than the earlier amorphous or amorphous/kaolin containing silica-alumina catalysts. This introduction of zeolitic cracking catalysts revolutionized the fluid catalytic cracking process. New processes were developed to handle these high activities, such as riser cracking, shortened contact times, new regeneration processes, new improved zeolitic catalyst developments, and the like.

The new catalyst developments revolved around the development of various zeolites such as synthetic types X and Y and naturally occurring faujasites; increased thermal-steam (hydrothermal) stability of zeolites through the inclusion of rare earth ions or ammonium ions via ion-exchange techniques; and the development of more attrition resistant matrices for supporting the zeolites. The zeolitic catalyst developments gave the petroleum industry the capability of greatly increasing throughput of feedstock with increased conversion and selectivity while employing the same units without expansion and without requiring new unit construction.

After the introduction of zeolite containing catalysts the petroleum industry began to suffer from a lack of crude availability as to quantity and quality accompanied by increasing demand for gasoline with increasing octane values. The world crude supply picture changed dramatically in the late 1960's and early 1970's. From a surplus of light-sweet crudes the supply situation changed to a tighter supply with an ever-increasing amount of heavier crudes, such as petroleum residues, having a higher sulfur content.

Petroleum resid(ue) is the heavy fraction remaining after distillation of petroleum crudes at atmospheric pressure (atmospheric resid) or at reduced pressure (vacuum resid). Resids have a high molecular weight and most often contain polycyclic aromatic hydrocarbons (PAH's). These molecules have more than 3-4 aromatic rings and provide the greatest limitation to the conversion of the resids into the desired products. This is because of their high stability and the lack of sufficient hydrogen in the ring structures to be converted to smaller more useful molecules. Moreover, the desired products, e.g. transportation fuels, are limited to alkylated single aromatic rings. No matter which type of resid conversion process is applied, a substantial fraction of resid molecules have fragments, which can be cracked off to become liquids (or gas) in the transportation fuels and vacuum oil boiling range. The aromatic cores cannot be cracked under FCC cracking conditions (in order to also remove these species hydrocracking must be considered). Therefore, one should not try to overly convert resids because then the selectivity will shift to the thermodynamically favored, but lower valued products: coke and gaseous hydrocarbons. As a result, gasoline yields are lower in resid FCC processing. These heavier and high sulfur crudes and resides present processing problems to the petroleum refiner in that these heavier crudes invariably also contain much higher metals with accompanying significantly increased asphaltic content. Typical contaminant metals are nickel, vanadium, and iron.

It has long been known that topped crudes, residual oils and reduced crudes with high contaminating metals levels present serious problems, as reducing the selectivity to valuable transportation fuels and as deactivating FCC catalysts at relatively high metal concentrations, e.g., 5,000-10,000 ppm in combination with elevated regenerator temperatures. It has also been particularly recognized that, when reduced crude containing feeds with high vanadium and nickel levels are processed over a crystalline zeolite containing catalyst, and especially at high vanadium levels on the catalyst, rapid deactivation of the zeolite can occur. This deactivation manifests itself in substantial measure as a loss of the crystalline zeolitic structure. This loss has been observed at vanadium levels of 1,000 ppm or less. The loss in the crystalline zeolitic structure becomes more rapid and severe with increasing levels of vanadium and at vanadium levels about 5,000 ppm, particularly at levels approaching 10,000 ppm complete destruction of the zeolite structure may occur. The effects of vanadium deactivation at vanadium levels of less than 10,000 ppm can be reduced by increasing the addition rate of virgin catalyst, but it is financially costly to do so. As previously noted, vanadium poisons the cracking catalyst and reduces its activity. The literature in this field has reported that vanadium compounds present in feedstock become incorporated in the coke which is deposited on the cracking catalyst and is then oxidized to vanadium pentoxide in the regenerator as the coke is burned off (M. Xu et al. J. Catal. V. 207 (2), 237-246). At 700-830° C. in the presence of air and steam, V will be in a surface mobile state in an acidic form. This V species reacts with cationic sodium, facilitating its release from the Y exchange site. The sodium metavanadate thus formed hydrolyzes in steam to form NaOH and metavanadic acid, which may again react with Na+ cations. V thus catalyzes the formation of the destructive NaOH.

Iron and nickel on the other hand are not mobile. The nickel containing hydrocarbons deposits on the catalyst and forms nickel oxide in the regenerator. In the riser section it may be reduced to metallic nickel, which, like metallic iron, catalyzes the dehydrogenation of hydrocarbons to form undesired hydrogen and coke. High hydrogen yields are undesirable because it can lead to limitations in the FCC downstream operations (the wet gas compressor is volume limited). High amounts of coke can otherwise lead to regenerator air blower constraints, which may result reduced feed throughput.

Because compounds containing vanadium and other metals cannot, in general, be readily removed from the cracking unit as volatile compounds, the usual approach has been to trap and/or passivate these compounds under conditions encountered during the cracking process. Trapping or passivation may involve incorporating additives into the cracking catalyst or adding separate additive particles along with the cracking catalyst. These additives combine with the metals and therefore either act as "traps" or "sinks" for mobile V species so that the active component of the cracking catalyst is protected, or passivators for immobile Ni and Fe. The metal contaminants are then removed along with the catalyst withdrawn from the system during its normal operation and fresh metal trap is added with makeup catalyst so as to affect a continuous withdrawal of the detrimental metal contaminants during operation. Depending upon the level of the harmful metals in the feedstock, the quantity of additive may be varied relative to the makeup catalyst in order to achieve the desired degree of metals trapping and/or passivation.

It is known to incorporate various types of alumina in the FCC catalyst particle for trapping vanadium and nickel. Examples of this can be found in commonly assigned U.S. Pat. Nos. 6,716,338 and 6,673,235, which add a dispersible boehmite to the cracking catalysts. Upon calcination, the boehmite is converted to a transitional alumina phase, which has been found useful in passivation of nickel and vanadium contaminants in the hydrocarbon feedstock. Meanwhile, high surface area aluminas may also serve to trap vanadium, protecting the zeolite, but not to passivate vanadium, so that the level of contaminant hydrogen and coke remains high.

Vanadium can also be trapped and effectively passivated by using alkaline earth metal containing traps (Ca, Mg, Ba) and/or Rare earth based traps, see the commonly assigned and co-pending application, U.S. Ser. No. 12/572,777; filed Oct. 2, 2009; U.S. Pat. Nos. 4,465,779; 4,549,958; 4,515,903; 5,300,469; and 7,361,264. However, these traps are sensitive to sulfur, and sulfur could block to active sites for vanadium trapping to make them less effective.

Usage of antimony and antimony compounds as passivators are also well known in the patent literature including U.S. Pat. Nos. 3,711,422; 4,025,458; 4,031,002; 4,111,845; 4,148,714; 4,153,536; 4,166,806; 4,190,552; 4,198,317; 4,238,362 and 4,255,287. Reportedly, the antimony reacts with nickel to form a NiSb alloy, which is difficult to reduce under riser conditions thus deactivting nickel for catalyzing the formation of hydrogen and coke. This process is commonly referred to as passivation.

U.S. Pat. No. 4,921,824 discloses a composition for passivating vanadium during the process of catalytic cracking, in which the composition comprises discrete particles of lanthanum oxide. The lanthanum oxide can be a discrete particle comprised of a matrix such as inert materials, including clays, aluminates, silicates, inorganic oxides such as silica and metal oxides and mixtures thereof. In a comparison example, the patent discloses an ammonium nitrate exchanged silica-alumina-clay matrix which was impregnated with an aqueous solution of lanthanum nitrate. The matrix comprised 75.6% silica and 17.1% alumina. The results of pilot tests indicated that the lanthanum impregnated matrix was not as effective as a pure lanthanum oxide passivating composition.

WO 2009/089020 also discloses a passivating composition, which can be combined with a zeolite-containing cracking catalyst to enhance catalytic activity and/or selectivity in the presence of metals, such as vanadium, and which composition comprises a rare earth carbonate, preferably lanthanum carbonate dispersed in a matrix. The matrix can be formed from precursors such as any inorganic oxide, including alumina. Matrix precursors other than those of alumina include silica, silica-alumina, and clay. The publication mentions a matrix formed from acid-reacted metakaolin clay.

SUMMARY OF THE INVENTION

The invention is directed towards an improved metal passitivator/trap composition comprising a discrete particle comprising a rare earth oxide dispersed within an attrition resistant matrix. The matrix is formed by spray drying hydrous kaolin into an appropriate particle size and calcining the hydrous kaolin particles. The rare earth oxide is formed either by impregnating the calcined matrix with a rare earth salt and then calcining the salt to the rare earth oxide, or incorporating a rare earth oxide or salt with the hydrous kaolin during spray drying, and subsequently calcining to convert any rare earth salt to the oxide thereof.

DETAILED DESCRIPTION OF THE INVENTION

This invention is directed towards an improved metal passivator/trap and its use in conjunction with a FCC catalyst to catalyze petroleum oil feeds containing significant levels of metals contaminants (i.e. Ni and/or V). Specifically, the metals passivator/trap comprises a rare earth oxide in an attrition resistant matrix to immobilize vanadium and nickel, such that the deactivation effect of the FCC catalyst by the metal contaminants in the hydrocarbon oil feeds is reduced and/or the selectivity towards transportation fuels is increased (of all types utilized in FCC operations). The invention is particularly useful in the processing of carbo-metallic oil components found in whole crudes, topped crude, residual oil and reduced crude feeds in a modern fluid catalytic cracking unit.

The process of the present invention comprises the catalytic cracking of hydrocarbonaceous feedstock using a catalyst mixture which comprises a first component of which is a cracking catalyst preferably contained within a matrix material, and a second component of which comprises a rare earth oxide as will be further described below having an effectiveness for metals passivation and metals trapping, and having an improved attrition resistance over prior art materials. The improvement of the present invention resides in the ability of the catalyst system to function well even when the feedstock contains high levels of metals.

It must be noted that "passivator" and "trap" are used herein interchangeably, and that the composition of the present invention contains components that may passivate and/or trap the metal contaminants. "Passivator" is defined as a composition that reduces the activity of unwanted metals, i.e. nickel and vanadium to produce contaminant $H_2$ and coke during the FCC process. While a "trap" is a composition that immobilizes contaminant metals that are otherwise free to migrate within or between microspheres in the FCC catalyst mixture, i.e. V and Na.

Cracking Catalyst

The cracking catalyst component employed in the process of the present invention can be any cracking catalyst of any desired type having a significant activity. Preferably, the catalyst used herein is a catalyst containing a crystalline aluminosilicate, preferably ammonium exchanged and at least partially exchanged with rare earth metal cations, and sometimes referred to as "rare earth-exchanged crystalline aluminum silicate," i.e. REY, CREY, or REUSY; or one of the stabilized ammonium or hydrogen zeolites.

Typical zeolites or molecular sieves having cracking activity are used herein as a catalytic cracking catalyst are well known in the art. Synthetically prepared zeolites are initially in the form of alkali metal aluminosilicates. The alkali metal ions are typically exchanged with rare earth metal and/or ammonium ions to impart cracking characteristics to the zeolites. The zeolites are crystalline, three-dimensional, stable structures containing a large number of uniform openings or cavities interconnected by smaller, relatively uniform holes or channels. The effective pore size of synthetic zeolites is suitably between, but not limited to, 6 and 15 Å in diameter.

Zeolites that can be employed herein include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, ferrierite, and the like. The faujasites are preferred. Suitable synthetic zeolites which can be treated in accordance with this invention include zeolites X, Y, including chemically or hydrothermally dealumintated high silica-alumina Y, A, L, ZK-4, beta, ZSM-types or pentasil, boralite and omega. The term "zeolites" as used herein contemplates not only aluminosilicates but also substances in which the aluminum is replaced by gallium or boron and substances in which the silicon is replaced by germanium. The preferred zeolites for this invention are the synthetic faujasites of the types Y and X or mixtures thereof. Alternatively, a cracking catalyst such as Flex-Tec®, NaphthaMax®, or Stamina® from BASF Corporation are also useful. The amount of catalytic catalyst used for the present invention is of about 30 to about 95 wt % of the catalyst mixture. An amount of about 50% to about %90 is also useful.

To obtain a good cracking activity the zeolites have to be in a proper form. In most cases this involves reducing the alkali metal content of the zeolite to as low a level as possible. Further, high alkali metal content reduces the thermal structural stability, and the effective lifetime of the catalyst will be impaired as a consequence thereof. Procedures for removing alkali metals and putting the zeolite in the proper form are well known in the art, for example, as described in U.S. Pat. No. 3,537,816.

The zeolite can be incorporated into a matrix. Suitable matrix materials include the naturally occurring clays, such as kaolin, halloysite and montmorillonite and inorganic oxide gels comprising amorphous catalytic inorganic oxides such as silica, silica-alumina, silica-zirconia, silica-magnesia, alumina-boria, alumina-titania, and the like, and mixtures thereof. Preferably the inorganic oxide gel is a silica-containing gel, more preferably the inorganic oxide gel is an amorphous silica-alumina component, such as a conventional silica-alumina cracking catalyst, several types and compositions of which are commercially available. These materials are generally prepared as a co-gel of silica and alumina, co-precipitated silica-alumina, or as alumina precipitated on a pre-formed and pre-aged hydrogel. In general, silica is present as the major component in the catalytic solids present in such gels, being present in amounts ranging between about 55 and 100 weight percent. Most often however, active commercial FCC catalyst matrix are derived from pseudo-boehmites, boehmites, and granular hydrated or rehydrateable aluminas such as bayerite, gibbsite and flash calcined gibbsite, and bound with peptizable pseudo-boehmite and/or colloidal silica, or with aluminum chlorohydrol. The matrix component may suitably be present in the catalyst of the present invention in an amount ranging from about 25 to about 92 weight percent, preferably from about 30 to about 80 weight percent of the FCC catalyst.

U.S. Pat. No. 4,493,902, the teachings of which are incorporated herein by cross-reference, discloses novel fluid cracking catalysts comprising attrition-resistant, high zeolitic content, catalytically active microspheres containing more than about 40%, preferably 50-70% by weight Y faujasite and methods for making such catalysts by crystallizing more than about 40% sodium Y zeolite in porous microspheres composed of a mixture of two different forms of chemically reactive calcined clay, namely, metakaolin (kaolin calcined to undergo a strong endothermic reaction associated with dehydroxylation) and kaolin clay calcined under conditions more severe than those used to convert kaolin to metakaolin, i.e., kaolin clay calcined to undergo the characteristic kaolin exothermic reaction, sometimes referred to as the spinel form of calcined kaolin. In a preferred embodiment, the microspheres containing the two forms of calcined kaolin clay are immersed in an alkaline sodium silicate solution, which is heated, preferably until the maximum obtainable amount of Y faujasite is crystallized in the microspheres.

In practice of the '902 technology, the porous microspheres in which the zeolite is crystallized are preferably prepared by forming an aqueous slurry of powdered raw (hydrated) kaolin clay ($Al_2O_3$:$2SiO_2$:$2H_2O$) and powdered calcined kaolin clay that has undergone the exotherm together with a minor amount of sodium silicate which acts as fluidizing agent for the slurry that is charged to a spray dryer to form microspheres and then functions to provide physical integrity to the components of the spray dried microspheres. The spray dried microspheres containing a mixture of hydrated kaolin clay and kaolin calcined to undergo the exotherm are then calcined under controlled conditions, less severe than those required to cause kaolin to undergo the exotherm, in order to dehydrate the hydrated kaolin clay portion of the microspheres and to effect its conversion into metakaolin, this resulting in microspheres containing the desired mixture of metakaolin, kaolin calcined to undergo the exotherm and sodium silicate binder. In illustrative examples of the '902 patent, about equal weights of hydrated clay and spinel are present in the spray dryer feed and the resulting calcined microspheres contain somewhat more clay that has undergone the exotherm than metakaolin. The '902 patent teaches that the calcined microspheres comprise about 30-60% by weight metakaolin and about 40-70% by weight kaolin characterized through its characteristic exotherm. A less preferred method described in the patent, involves spray drying a slurry containing a mixture of kaolin clay previously calcined to metakaolin condition and kaolin calcined to undergo the exotherm but without including any hydrated kaolin in the slurry, thus providing microspheres containing both metakaolin and kaolin calcined to undergo the exotherm directly, without calcining to convert hydrated kaolin to metakaolin.

In carrying out the invention described in the '902 patent, the microspheres composed of kaolin calcined to undergo the exotherm and metakaolin are reacted with a caustic enriched sodium silicate solution in the presence of a crystallization initiator (seeds) to convert silica and alumina in the microspheres into synthetic sodium faujasite (zeolite Y). The microspheres are separated from the sodium silicate mother liquor, ion-exchanged with rare earth, ammonium ions or both to form rare earth or various known stabilized forms of catalysts. The technology of the '902 patent provides means for achieving a desirable and unique combination of high zeolite content associated with high activity, good selectivity and thermal stability, as well as attrition-resistance.

Metal Passivator/Trap

The metal passivator/trap of the present invention is in the form of discrete particles and, as used in the present invention, will comprise one rare earth oxide or a mixture of rare earth oxides. Where the discrete particle comprises one rare earth oxide, the rare earth oxide is preferably lanthanum or cerium. Although the composition will be referred to as a rare earth oxide, it is believed that the actual trapping component is a mixture of oxide and rare earth aluminate salts. Accordingly, the term "rare earth oxide" as used herein is meant to include rare earth aluminate salts. Where the discrete particles comprise a mixture of rare earth oxides, the mixture preferably includes lanthanum or cerium and at least one member of the lanthanide series, preferably one or more of the lighter lanthanides, i.e., lanthanum, cerium, praseodymium, neodymium, promethium, or samarium.

The rare earth oxides in the discrete particles of the present invention are formed by one of several processes. In the first process, inert matrix particles are impregnated with a rare earth salt and the impregnated particles then calcined in an oxygen-containing atmosphere to convert the salt to the rare earth oxide. Although not limited to water soluble salts, such materials are preferred and are well known in the art and include acetates, halides, nitrates, sulfates and the like. Lanthanum nitrate is a particularly useful rare earth salt. Incipient wetness techniques can be used to impregnate the inert matrix with the rare earth salt.

In an alternative process, a rare earth salt or oxide is spray dried with an inert matrix precursor to form a particle containing a mixture of matrix and rare earth. The particle mixture can be calcined to convert any rare earth salt to oxide. In this embodiment, it is preferred that the rare earth salt be a solid such as, for example, rare earth carbonate.

The amount of rare earth oxide in the discrete particles is not critical. The amount of rare earth oxide in the discrete particles may be as little as about 5%, but is preferably at least about 15%, and, more preferably, at least about 25% by weight of the discrete particles. In general, the greater the amount of rare earth in the discrete particle, the better will be the improvement in catalyst performance.

The inert material, which forms the matrix of the discrete particle of the passivator/trap of this invention, is important in that the matrix must have sufficient attrition resistance to maintain the integrity of the particle during the cracking and regenerating steps of the cracking process. Inert means inactive or significantly less active than the cracking catalyst that is used in the catalytic cracking process.

If the trap of this invention is formed by the first process as disclosed above, the inert material which forms the matrix of the passivator/trap of the present invention is to be formed from hydrous kaolin which has been heated to a temperature above 1,050° C., thus, at a temperature beyond the characteristic exotherm of kaolin to yield a sufficient amount of mullite. The mullite-containing particle has improved properties of attrition resistance. Thus, hydrous kaolin is calcined at a temperature above that designated, and at a time sufficient to yield a mullite index of at least 15, and, preferably, a mullite index of at least 35. Mullite index is a quantitative x-ray diffraction method used to quantify the amount of mullite in a material. The quantification is done by integrating the area of a peak, or peaks, and comparing the integrated peak intensity of the unknown sample to a calibration curve. The calibration curve is typically formed by running samples consisting of 10% increments of mullite from 0% to 100%. Thus, a mullite index of 35 indicates that the sample contains about 35% mullite. Since mass absorption or preferred orientation typically are not taken into account, the mullite index value cannot exactly be termed as percent, but can be used in a relative sense as a useful percent range of mullite in the sample. In general, after calcination, the inert matrix typically has from 40-60% $SiO_2$ and 60-40% $Al_2O_3$.

In an alternative process, the spray dried particulate mixture of inert matrix precursor, i.e. hydrous kaolin, and rare earth salt or oxide and, optionally, a binder is calcined to convert any rare earth salt to the oxide thereof. Accordingly, much lower calcination temperatures can be used in the alternative process than used in the first process which transforms the hydrous kaolin to a spinel containing a mullite phase. In this alternative case, the attrition resistance is provided by the hydrous kaolin and any binder included in the mixture which is spray dried. After any conversion of rare earth salt to oxide, the inert matrix will have from 40-60% $SiO_2$ and 60-40% $Al_2O_3$.

The process for forming the passivator/trap of the present invention involves spray drying a hydrous kaolin slurry, typically comprising 40-60 wt. % kaolin solids in water. The slurry can be formed by adding a small amount of clay dispersant such as tetrasodium pyrophosphate and then mixing using high sheer. By employing the dispersant or deflocculating agent, the spray drying can be conducted with higher proportions of solids, which generally leads to a harder product. With deflocculating agents, it is possible to produce hydrous kaolin suspensions which contain about 55-60% solids. In the alternative process, the rare earth salt or oxide, and binder, such as colloidal silica are also mixed with the kaolin slurry. If as preferred, the rare earth salt is a solid, the solid salt can be first formed as a slurry in water and then subsequently added to the hydrous kaolin slurry along with binder. Additional useful binders include sodium silicate, peptizable alumina, etc.

The spray dryers used can have counter-current or co-current, or a mix counter-current/co-current movement of the suspension and the hot air for the production of microspheres. The air can be heated electrically or by any other indirect means. Combustion gases, such as those obtained in the air from the combustion of hydrocarbon heating oils can also be used.

If a co-current dryer is used, the air inlet temperature can be as high as 649° C. (1200° F.), and the kaolin should be charged at a rate sufficient to guarantee an air outlet temperature of about 121° to 316° C. (250 to 600° F.). At these temperatures, the free moisture of the suspension is driven away without removing the water of hydration (water of crystallization) from the crude kaolin component. A dehydration of part or all of the kaolin during the spray drying may be envisioned. The product from the spray dryer can be fractioned in order to obtain microspheres of the desired particle size. The particles used in the present invention have diameters in the range of 10 to 200 microns, preferably about 40 to 150 microns, more preferably about 60 to 90 microns. The calcination to a particle containing mullite, or to convert any rare earth salt to oxide can be conducted later during the production period or by introducing the spray dried particles directly into a calcining apparatus.

Subsequent to the formation of the spray dried hydrous kaolin particles, the particles are heated in air. It is well-known that when kaolin is heated in air, a first transition occurs at about 550° C. associated with an endothermic dehydroxylation reaction. The resulting materials are generally referred to as metakaolin. Metakaolin persists until the material is heated to about 975° C. and begins to undergo an exothermic reaction. This material is frequently described as kaolin which has undergone the characteristic exothermic reaction. Some authorities refer to this material as a defect aluminum-silicon spinel or as a gamma-alumina phase. On further heating to about 1,050° C., a high temperature phase, including mullite begins to form. The extent of conversion to mullite is dependent on a time/temperature relationship and the presence of mineralizers, as is well known in the art. Under the first process of this invention, the temperature of calcination and time is sufficient to convert at least a portion of the spray dried hydrous kaolin particles to a spinel and yield a mullite index of at least 15, and, preferably, a mullite index of at least about 35.

Subsequent to the calcination of the kaolin microsphere to a particle containing mullite, the particle is then impregnated with the rare earth salt such as the lanthanum salt, typically lanthanum nitrate by the incipient wetness method. Continued impregnations can be accomplished until the amount of lanthanum oxide formed in the particle is at least about 10 weight percent, subsequent to calcination. Thus, after the particle has been impregnated with sufficient rare earth salt, the impregnated particle is then calcined at a temperature of at least 350° C. for a time sufficient to convert the salt to the rare earth oxide form.

Under the alternative process, the spray dried particles containing a mixture of hydrous kaolin, rare earth salt or oxide and binder are calcined in an oxygen-containing atmosphere to convert any rare earth salt to the oxide thereof. Excessive temperatures are to be avoided. Thus, the temperature should be sufficient to convert the salt to the oxide and prevent further reaction of the rare earth metals and the matrix or binder, although minor reactions are acceptable. Typically, the temperature of calcination will be below 975° C., and preferably below 550° C. to maintain the kaolin in hydrated form.

The metal passivator/trap may be blended with separate zeolite catalyst particles before being introduced to an FCC unit. Alternatively, the passivator/trap particles can be charged separately to the circulating catalyst inventory in the cracking unit. Typically the metal passivation particles are present in amounts within the range of 1 to 50% by weight, preferably 2 to 30% by weight, and most preferably 5 to 25% by weight of the catalyst mixture. When used in insufficient amounts, improvements in vanadium and nickel passivation may not be sufficient. When employed in excessive amounts, cracking activity and/or selectivity may be impaired, and the operation becomes costly. Optimum proportions vary with the level of metal contaminants within oil feeds. Accordingly, with the metal trapping component acts as a scavenger for the mobile metal contaminants, preventing such contaminants from reaching the cracking centers of the catalytically active component, the concentration of the passivator/trap in the catalyst mixture can be adjusted so as to maintain a desired catalyst activity and conversion rate, preferably a conversion rate of at least 55 percent. The passivator/trap of this invention is particularly useful for cracking oil feed containing a level of metal contaminants (i.e. Ni and/or V), having concentrations in the range of about 0.1 ppm of nickel and/or 0.1 ppm of vanadium, to about 200 ppm of metal contaminants comprising Nickel, Vanadium, Iron, and/or mixture thereof. However, it must be noted that during the FCC cracking, the amount of metal contaminants accumulated on the FCC catalyst can be as minimally as 300 ppm to as high as 40,000 ppm of metal contaminants comprising Nickel, Vanadium, Iron, and/or mixture thereof.

FCC Cracking Process

The catalytic cracking reaction temperature in accordance with the above-described process is at least about 900° F. (482° C.). The upper limit can be about 1100° F. (593.3° C.) or more. The preferred temperature range is about 950° F. to about 1050° F. (510° C. to 565.6° C.). The reaction total pressure can vary widely and can be, for example, about 5 to about 50 psig (0.34 to 3.4 atmospheres), or preferably, about 20 to about 30 psig (1.36 to 2.04 atmospheres). The maximum riser residence time is about 5 seconds, and for most charge stocks the residence time will be about 1.0 to about 2.5 seconds or less. For high molecular weight charge stocks, which are rich in aromatics, residence times of about 0.5 to about 1.5 seconds are suitable in order to crack mono- and di-aromatics and naphthenes which are the aromatics which crack most easily and which produce the highest gasoline yield, but to terminate the operation before appreciable cracking of polyaromatics occurs because these materials produce high yields of coke and $C_2$ and lighter gases. The length to diameter ratio of the reactor can vary widely, but the reactor should be elongated to provide a high linear velocity, such as about 25 to about 75 feet per second; and to this end a length to diameter ratio above about 20 to about 25 is suitable. The reactor can have a uniform diameter or can be provided with a continuous taper or a stepwise increase in diameter along the reaction path to maintain a nearly constant velocity along the flow path.

The weight ratio of catalyst to hydrocarbon in the feed is varied to affect variations in reactor temperature. Furthermore, the higher the temperature of the regenerated catalyst, the less catalyst is required to achieve a given reaction temperature. Therefore, a high regenerated catalyst temperature will permit the very low reactor density level set forth below and thereby help to avoid back mixing in the reactor. Generally catalyst regeneration can occur at an elevated temperature of about 1250° F. (676.6° C.) or more. Carbon-on-catalyst of the regenerated catalyst is reduced from about 0.6 to about 1.5, to a level of about 0.3 percent by weight. At usual catalyst to oil ratios, the quantity of catalyst is more than ample to achieve the desired catalytic effect and therefore if the temperature of the catalyst is high, the ratio can be safely decreased without impairing conversion. Since zeolitic catalysts, for example, are particularly sensitive to the carbon level on the catalyst, regeneration advantageously occurs at elevated temperatures in order to lower the carbon level on the catalyst to the stated range or lower. Moreover, since a prime function of the catalyst is to contribute heat to the reactor, for any given desired reactor temperature the higher the temperature of the catalyst charge, the less catalyst is required. The lower the catalyst charge rate, the lower the density of the material in the reactor. As stated, low reactor densities help to avoid back mixing.

It is to be understood that the catalyst mixture described above can be used in the catalytic cracking of any hydrocarbon charge stock containing metals, but is particularly useful for the treatment of high metals content charge stocks. Typical feedstocks are heavy gas oils or the heavier fractions of crude oil in which the metal contaminants are concentrated. Particularly preferred charge stocks for treatment using the catalyst mixture of the present invention include deasphalted oils boiling above about 900° F. (482° C.) at atmospheric pressure; heavy gas oils boiling from about 600° F. to about 1100° F. (343° C. to 593° C.) at atmospheric pressure; atmospheric or vacuum tower bottoms boiling above about 650° F.

The metal passivator/trap may be added to the FCC unit via an additive loader in the same manner as CO promoters and other additives. Alternatively, the metal passivator/trap may be pre-blended with the fresh FCC catalyst being supplied to the FCC unit.

Attrition resistance is measured by a proprietary developed test called the Roller. The lower the Roller number, the more attrition resistant the discrete particles. Roller numbers of less than 20 are acceptable for typical FCC operation with Roller numbers less than 15 more desired. The Roller Procedure is described in U.S. Pat. No. 5,082,814, the teachings of which regarding this test procedure are incorporated herein by cross-reference.

Example 1

Preparation of Substrate Matrix

A slurry consisting of a hydrous clay (UMF supplied by BASF Corporation), tetrasodium pyrophosphate clay dispersant (10 lb/ton) and water were made down to a kaolin solids content of 60% by weight using a high shear drill press mixer. This grade of kaolin is approximately 80% by weight finer than 2 microns. The slurry was screened to remove any agglomerates, and spray dried to a particle size similar to FCC catalyst (about 70 μm APS). The spray dried particles were then calcined at a temperature above 1175° C. so that its mullite index was 35. BET surface area was 13 $m^2$/gm, APS=73 μm.

The examples below describe the preparation of Rare-earth contained Vanadium traps.

Example 2

Preparation of Invention 4184 g of the substrate sample of Example 1 were impregnated with 2476 g of lanthanum nitrate solution in 2 passes. The sample was dried at 120° C. overnight after each pass. The resulting sample was calcined at 400° C. for 2 hours. $La_2O_3$ analysis was 13.5 wt %. The roller number was 6.

Example 3

Preparation of Invention 4184 g of the substrate sample of Example 1 were impregnated with 2476 g of lanthanum nitrate solution in 2 passes. The sample was dried at 120° C. overnight after each pass. The resulting sample was calcined at 500° C. for 2 hours. $La_2O_3$ analysis was 13.5 wt %. The roller number was 2.

Example 4

Preparation of Invention 2000 g of the substrate sample of Example 1 was impregnated with 2836 g of lanthanum nitrate solution in 4 passes. The sample was dried at 120° C. overnight after each pass. The resulting sample was calcined at 400° C. for 2 hours. $La_2O_3$ analysis was 27.35 wt %. The roller number was 6.

Example 5

Preparation of Invention 1000 g of the substrate sample of Example 1 was impregnated with 2091 g of lanthanum nitrate solution in 6 passes. The sample was dried at 120° C. overnight after each pass. The resulting sample was calcined at 400° C. for 2 hours. $La_2O_3$ analysis was 35.7 wt %. The roller number was 8.

Example 6

Preparation of Invention 1500 g of the substrate sample of Example 1 was impregnated with 1883 g of cerium nitrate solution in 4 passes. The sample was dried at 120° C. overnight after each pass. The resulting sample was calcined at 400° C. for 2 hours. $CeO_2$ analysis was 25 wt %. The roller number was 5.

Example 7

Preparation of Invention

Lanthanum carbonate was made down with water to a solids content of 53% by weight using a high shear drill press mixer. The particle size of the lanthanum carbonate slurry is 50% by weight finer than 14 μm. the lanthanum carbonate slurry was milled with a Premier miller and the particle size was reduced to 50% by weight finer than 5 μm. A slurry consisting of 620 g hydrous clay (UMF supplied by BASF Corporation), 1793 g milled lanthanum carbonate slurry, 41.8 g colloidal silica (15% SiO2 by wt) (#2326 supplied by Nalco company) and 1110 g water were made down to a solids content of 45% by weight using a high shear drill press mixer. The slurry was screened to remove any agglomerates, and spray dried to a particle size similar to FCC catalyst (~70 μm APS). The spray dried particles were then calcined at a temperature of 400° C. for 2 hours. $La_2O_3$ analysis was 32.1 wt %. The roller number was 15.

Example 8

Preparation of Invention

Lanthanum acetate is made down with water to a solids content of 53% by weight using a high shear drill press mixer. A slurry consisting of 620 g hydrous clay (UMF supplied by BASF Corporation), 1793 g lanthanum acetate slurry, 41.8 g colloidal silica (15% SiO2 by wt) (#2326 supplied by Nalco company) and 1110 g water are made down to a solids content of 45% by weight using a high shear drill press mixer. The slurry is screened to remove any agglomerates, and spray dried to a particle size similar to FCC catalyst (~70 μm APS). The spray dried particles are then calcined at a temperature of 400° C. for 2 hours. $La_2O_3$ analysis is 29.9 wt %. The roller number is 10.

Example 9

Comparative Sample

The comparative sample is prepared according to example #9 illustrated in U.S. Pat. No. 5,384,041. It is a commercially available MgO based Vanadium trap, manufactured by BASF corp, having surfare area of 13 m2/g and roller number of 5.

Example 10

Testing of Vanadium Trapping Effectiveness

The effectiveness of these particles as a vanadium trap was tested by the procedure described in U.S. Pat. No. 5,384,041, incorporated herein by reference. It is well-known that the resid feed contains contaminants metals, such as vanadium, nickel, iron and sodium etc. The metal levels normally increase with the levels of resid processing. The metal containing molecules undergo thermal decomposition when the feedstock is contacted with the hot catalyst in the base of the riser reactor. Vanadium is deposited onto the catalyst surface and destroy the zeolite. To simulate transfer of the vanadium from the zeolitic cracking catalyst particles to the vanadium trap particles during the FCC cycle, we made a separate vanadium-containing sample as the vanadium source. Vanadium from vanadium naphthenate was deposited over chemically neutral microspheres by using vanadium naphthenate of 1.5% concentration in hexane over 500 grams of a highly calcined clay (1150° C.) to obtain a loading of about 10,000 ppm vanadium. The impregnated particles were then dried overnight and calcined first at 315° C. and then at 593° C. and designated as the vanadium source. Vanadium analysis of these particles showed the presence of 10,000 ppm. Vanadium was analyzed by inductively coupled plasma spectroscopy (ICP). Zeolitic fluidizable cracking catalysts used in this invention were manufactured by BASF Corporation. Fifteen grams of zeolitic fluidizable cracking catalysts were blended with 6 grams of each of the vanadium trap materials and 9 grams of vanadium source material, whereby the final catalyst blend contained 3000 ppm V. A companion blend was also prepared replacing the vanadium source with vanadium-free particles, Particles with no V were highly calcined kaolin clay particles (1175° C.) that had less than 3 $m^2/g$ surface area and no catalytic cracking activity. After steaming at 788° C. for 4 hours in a 90% steam/10% air atmosphere, the blends were tested for surface area and % ZSA maintenance.

$$ZSA\ \text{maintenance} = \frac{[ZSA\ \text{of Blend with Vanadium source}]}{[ZSA\ \text{of Blend without Vanadium source}]}$$

TABLE

ZSA maintenance

| Example# | ZSA maintenance |
|---|---|
| Example 9 (comparative sample #1) | 79.9% |
| Example 1 (comparative sample #2) | 74.8% |
| Example 2 | 81.5% |
| Example 4 | 82.5% |
| Example 5 | 85.2% |
| Example 7 | 82.3% |

The invention claimed is:

1. A method of passivating and/or trapping at least one metal contaminant from a hydrocarbon oil feed in an FCC unit bed comprising contacting the hydrocarbon oil feed containing the at least one metal contaminant with a catalyst mixture, the catalyst mixture having been formed by physically blending 1) an FCC catalyst, and 2) metal trap particles comprising catalytically inactive materials, the catalytically inactive materials comprising:

a matrix; and a rare earth oxide dispersed within the matrix, the rare earth oxide comprising a mixture of oxide and rare earth aluminate salts.

2. The method of claim 1, wherein the rare earth oxide is lanthanum oxide.

3. The method of claim 2, wherein the lanthanum oxide is present in an amount of at least 5 wt. % of the metal trap.

4. The method of claim 3, wherein the lanthanum oxide is present in an amount of at least 15 wt. % of the metal trap.

5. The method of claim 1, wherein the matrix has a mullite content of at least about 15 wt. %.

6. The method of claim 5, wherein the matrix has a mullite content of at least about 35 wt. %.

7. The method of claim 1, wherein the matrix comprises 40-60 wt. % $SiO_2$ and 60-40 wt % $Al_2O_3$.

8. The method of claim 1, wherein the at least one metal contaminant is selected from nickel, vanadium, or mixtures thereof.

9. The method of claim 1, wherein the metal trap particles have a size range of 40-150 microns.

10. The method of claim 5, wherein the matrix is formed by calcining hydrous kaolin at a temperature of at least 1050° C.

* * * * *